US005676310A

United States Patent [19]

Hynds

[11] Patent Number: 5,676,310

[45] Date of Patent: Oct. 14, 1997

[54] METHOD AND SYSTEM FOR AIR SPRAY COATING AND MANUALLY-OPERATED ATOMIZING DEVICE FOR USE THEREIN

[76] Inventor: James E. Hynds, 30946 Sunderland, Farmington Hills, Mich. 48331

[21] Appl. No.: 509,992

[22] Filed: Aug. 1, 1995

Related U.S. Application Data

[63] Continuation-in-part of Ser. No. 230,076, Apr. 20, 1994, Pat. No. 5,478,014.

[51] Int. Cl.[6] ..... B05B 1/28

[52] U.S. Cl. ..... 239/8; 239/296; 239/300

[58] Field of Search ..... 239/8, 11, 290, 239/296, 300, 415, 416.1

[56] References Cited

U.S. PATENT DOCUMENTS

| | | | |
|---|---|---|---|
| 2,107,732 | 2/1938 | Gustafson et al. . | |
| 2,438,471 | 3/1948 | Ball | 239/300 |
| 2,737,415 | 3/1956 | Wheeler-Nicholson | 239/290 |
| 3,589,621 | 6/1971 | Bradley . | |
| 4,132,357 | 1/1979 | Blackinton | 239/11 |
| 4,163,511 | 8/1979 | Kecskemthy et al. . | |
| 4,593,360 | 6/1986 | Cocks | 364/468 |
| 4,621,770 | 11/1986 | Sayen . | |
| 4,998,672 | 3/1991 | Bordaz et al. . | |
| 5,092,362 | 3/1992 | Yie . | |

*Primary Examiner*—Andres Kashnikow
*Assistant Examiner*—Robin O. Evans
*Attorney, Agent, or Firm*—Brooks & Kushman P.C.

[57] ABSTRACT

A manually-operated air atomizing device includes a trigger-operated valve which generates pneumatic control signals. The atomizing air, fan air and fluid supply are varied according to the position of the trigger. A set of preprogrammed valves control the proportion of atomizing air, fan air and fluid delivered to the atomizing device in response to the pneumatic control signals.

20 Claims, 4 Drawing Sheets

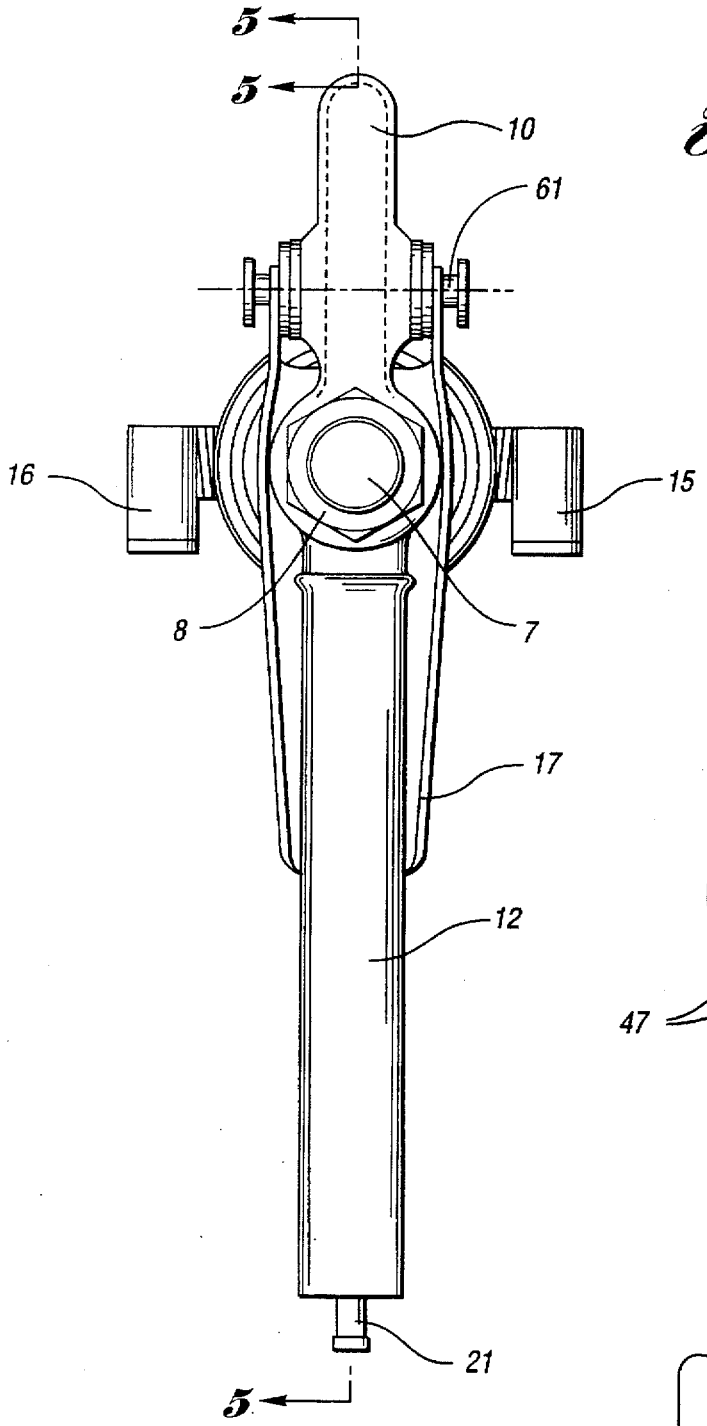
Fig. 2
Fig. 3
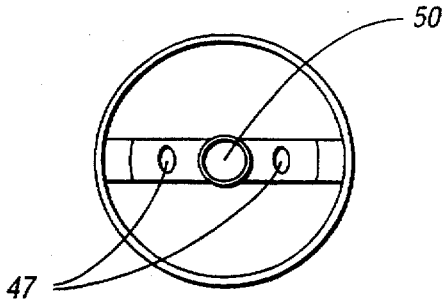
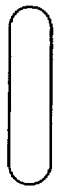
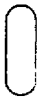
Fig. 4a Fig. 4b

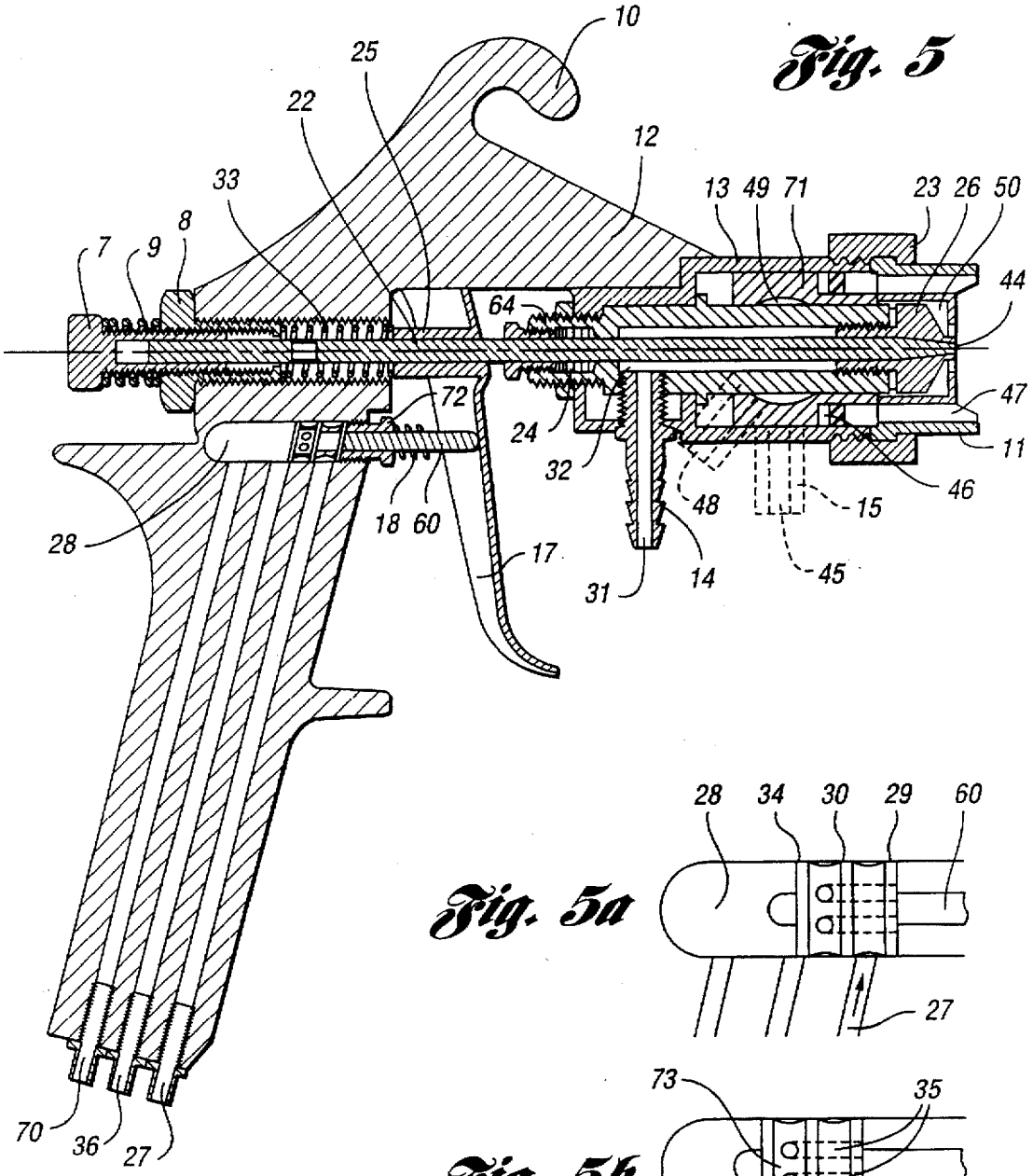
Fig. 5
Fig. 5a
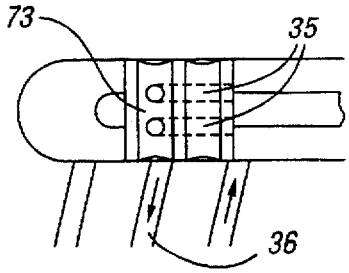
Fig. 5b
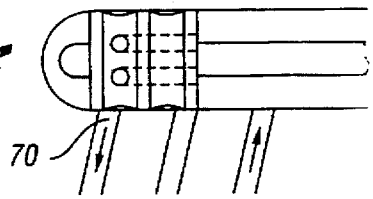
Fig. 5c

METHOD AND SYSTEM FOR AIR SPRAY COATING AND MANUALLY-OPERATED ATOMIZING DEVICE FOR USE THEREIN

CROSS-REFERENCE TO RELATED APPLICATION

This application is a continuation-in-part application of U.S. patent application Ser. No. 08/230,076, filed Apr. 20, 1994 now U.S. Pat. No. 5,478,014, entitled "Method and System for Hot Air Spray Coating And Atomizing Device For Use Therein".

TECHNICAL FIELD

This invention relates to methods and systems for air spray coating and atomizing devices for use therein and, in particular, to methods and systems for hand-held air spray coating and atomizing devices for use therein.

BACKGROUND ART

Due to increasing efforts by state and federal agencies to control emission of ozone depleting substances, emission sources are being carefully monitored. Specifically, source outputs are being limited by permits.

When a coating is applied by conventional high pressure (60 lbs./sq.in.) or "HVLP" hand spray atomizers (10 lbs./sq.in.), fan air and atomizing air are regulated with a single air regulator. The fluid pressure is by means of a fluid regulator or an air regulator on a pressure vessel or pump mechanism.

Air and fluid to the atomizing device are set at pressures high enough to spray the largest area of the object to be sprayed. A typical hand-held atomizing device has a single air source coupled to the atomizer which is then split by a valve in the atomizer. The valve rations the air to separate fan and atomizing ports in the air cap.

Typically, this valve in the atomizer is adjusted by hand and is preset to accommodate the largest area of the object to be sprayed. Adjusting the fan size down to accommodate a smaller area of the part while spraying, requires a very difficult maneuver with the opposite hand which is often occupied holding hoses or indexing the object to be sprayed. An alternative maneuver would be to stop spraying midway through the part, and make fan adjustments using both hands. Then, the sprayer would resume spraying the same part.

In the same manner, a fluid valve on the hand-held atomizer should be adjusted to match fan air delivery. This is cumbersome and time consuming and is left to the operator's discretion as to air and fluid settings. Typically, the sprayer presets the air and fluid valves to accommodate the largest area of the object. This results in much coating waste and high emission of VOC. While the idea of programming fan air, atomizing air and fluid to automatic spray atomizers is not new, no means or method has been developed to program fan air, atomizing air and coating material for hand spray devices.

For example, U.S. Pat. No. 4,593,360 discloses a fluid spray control system including a computer which controls the fluid sprayed, atomizing gas and fan gas.

U.S. Pat. Nos. 2,107,732 and 3,589,621 disclose hand spray guns having control valves to turn them on or off.

U.S. Pat. No. 5,092,362 discloses a hand spray gun having control valves for turning it on and off and including means for regulating spray pressure.

U.S. Pat. No. 4,163,511 and 4,621,770 disclose spray guns having plural, finger-actuated, control valves for selectively opening various supply lines.

U.S. Pat. No. 4,998,672 discloses a spray gun having trigger-actuated means for remotely varying the flow rate of an air supply by an electrical signal representing the trigger position.

SUMMARY OF THE INVENTION

An object of the present invention is to provide a method, system and a manually-operated atomizing device for use therein which solves the problems of the prior art including excessive coating waste by "programming" fan air, atomizing air and coating material for the atomizing device.

Another object of the present invention is to provide a method, system and an atomizing device for use wherein the flow rates of atomizing air, fan air and coating material are controlled according to the position of a trigger of the atomizing device.

In carrying out the above objects and other objects of the present invention, a method is provided for air spray coating an article with a coating material. The method includes the steps of manually generating a first control signal, supplying atomizing air to an atomizing device having a spray head at a first predetermined flow rate in response to the first control signal, supplying the coating material to the atomizing device at a second predetermined flow rate in response to the first control signal, and supplying fan air to the atomizing device at a third predetermined flow rate in response to the first control signal. The method also includes the steps of manually generating a second control signal, supplying the atomizing air to the atomizing device at a fourth predetermined flow rate in response to the second control signal, supplying the coating material to the atomizing device at a fifth predetermined flow rate in response to the second control signal, and supplying the fan air to the atomizing device at a sixth predetermined flow rate in response to the second control signal. The atomizing air, the fan air and the coating material are independently controlled.

Further in carrying out the above objects and other objects of the present invention, a system is provided for air spray coating an article with a coating material. The system includes means for manually generating first and second control signals, and an atomizing device having an input coating passage, a separate atomizing air passage, a separate fan air passage and a spray head. The system also includes a source of coating material fluidly coupled to the input coating passage of the atomizing device for supplying the coating material to the atomizing device and a source of pressurized air coupled to the atomizing air and fan air passages of the atomizing device for supplying atomizing air and fan air, respectively, to the atomizing device. Finally, the system includes control means for fluidly coupling the source of coating material to the input coating passage and for coupling the source of pressurized air to the atomizing air and fan air passages. The control means is responsive to the first control signal to (1) cause the atomizing air to flow from the source of pressurized air to the atomizing air passage at a first predetermined flow rate, (2) cause the coating material to flow from the source of coating material to the input coating passage at a second predetermined flow rate, and (3) cause the fan air to flow from the source of pressurized air to the fan air passage at a third predetermined flow rate. The control means is also responsive to the second control signal to (4) cause the atomizing air to flow from the source of pressurized air to the atomizing air passage at a fourth predetermined flow rate, (5) cause the coating material to flow from the source of coating material to the input coating passage at a fifth predetermined flow rate, and (6) cause the fan air to flow from the source of pressurized air to the fan air passage at a sixth predetermined flow rate. The atomizing air, the fan air and the coating material are independently controlled.

Still further in carrying out the above objects and other objects of the present invention, an atomizing device is provided for air spray coating an article with a coating material. The atomizing device includes a body, a spray head mounted on the body, an atomizing air passage for receiving atomizing air, a separate fan air passage for receiving fan air, an input coating passage for receiving coating material, and means mounted on the body for manually generating first and second control signals for independently controlling predetermined flow rates of the atomizing air, the fan air and the coating material.

Preferably, the atomizing device further includes a positionable trigger mounted on the body. Also, the means for manually generating includes a valve coupled to the trigger for manually generating the first and second control signals in response to the position of the trigger.

Also preferably, the valve is a pneumatic valve and the first and second control signals are pneumatic control signals.

Still preferably, the atomizing device further includes an input pneumatic control passage adapted to be coupled to a source of pressurized air and a pair of output pneumatic control passages. Each of the input and output pneumatic control passages are formed in the body. The valve selectively fluidly communicates the input pneumatic control passage with one of the output pneumatic control passages in response to the position of the trigger to manually generate its corresponding pneumatic control signal.

The hand atomizer provides a method for the operator to signal preprogrammed fan air, atomizing air and fluid delivery. The atomizer separates fan air and atomizing air allowing each to be controlled independently. The method varies fan air, atomizing air and fluid delivery based on size and configuration of the object to be coated. The method includes a hand-held atomizer which by means of a trigger-valve mechanism activates preprogrammed valves which, in turn, control atomizing air, fan air as well as fluid delivery. The atomizing device mixes atomizing air with fluid at the air cap. Fan air is then directed at the atomized coating to form a flat spray (i.e., fan). The size of the fan is then determined mainly by the pressure of fan air, but also by atomizing air and fluid pressures. Typically, the air has a total flow rate in excess of 5 SCFM at the spray head at a fluid delivery pressure of less than 50 lbs. per square inch. Fluid pressure at the tip is generally between ½ lb. per square inch to 20 lbs. per square inch.

The atomizing device sends one or more signals to preprogrammed or manually preset valves. The spray operator conveniently selects one of several air signals which best suits the configuration of the parts being sprayed thus avoiding waste.

Further, remote valves for atomizing air supply, fan air supply, and fluid supply are located in the same general area. These valves can be set manually or air piloted by programmed transducers.

The advantages accruing to the method, system and atomizing device described above are numerous. For example, if an object to be sprayed has both large surface areas and small surface areas, the operator, using one hand, can conveniently select the optimum fan air, atomizing air and fluid delivery simply by positioning the trigger device to "call" a specific air signal. The operator gets a specific fan configuration and fluid delivery rate which has been predetermined. There is no need to attempt special adjustments to the gun valves with the other hand.

Also, an object with a large area on the front and back but narrow edges such as a door can be sprayed using much less coating. The operator would position the trigger valve to call a very wide fan and high material delivery to the front and back of the door. However, the operator would move the trigger to a different position which will signal a different set of variables for the narrow sides. Of course, the fan air valves, and fluid valves would be preset or preprogrammed to deliver low level of air and fluid to the atomizer. Coating usage would thus be preserved in the narrow areas of the part.

The advantages of the present invention will be readily appreciated as the same can be better understood by reference to the following detailed description when taken in connection with the accompanying drawings.

BRIEF DESCRIPTION OF THE DRAWINGS

FIG. 2 is a rear elevational view of the atomizing device of FIG. 1;

FIG. 3 is a front view of an air distributor or cap of the atomizing device;

FIGS. 4*a* and 4*b* are views illustrating high fan air and fluid and low fan air and fluid, respectively, of the method and system of the present invention;

FIG. 5 is a sectional view of the atomizing device taken along lines 5—5 of FIG. 2 and illustrating a trigger-operated pneumatic valve;

FIGS. 5*a* through 5*c* are enlarged schematic views, partially broken away, illustrating a rest valve position, a small fluid, fan and atomizing air position and a large fluid, fan and atomizing air position, respectively.

BEST MODE FOR CARRYING OUT THE INVENTION

Figure 1:
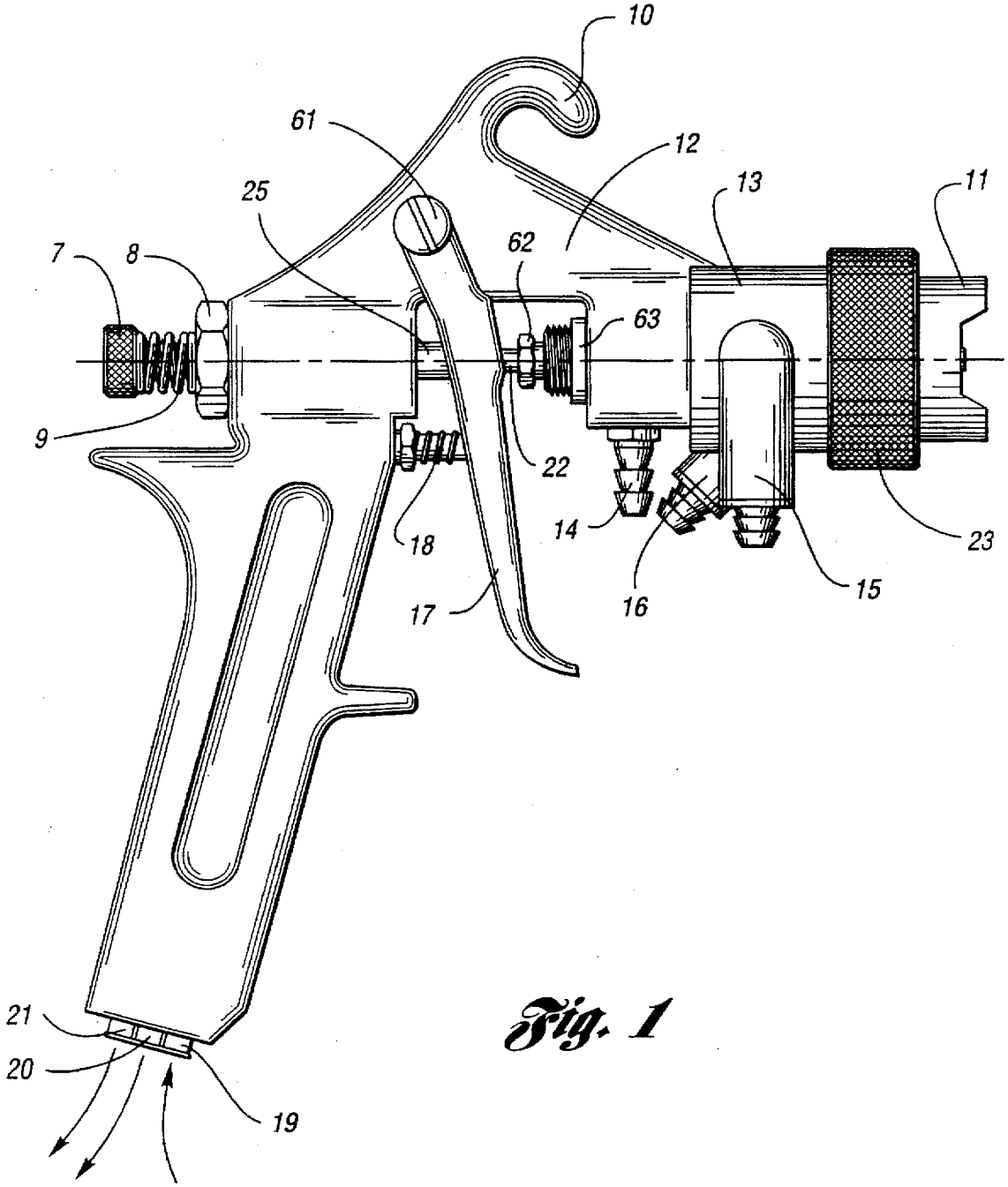
FIG. 1 is a side elevational view of an atomizing device for use in the method and system of the present invention.

Referring now to the drawing Figures, there is illustrated in FIG. 1 a manual or hand-held atomizer or atomizing device in the form of a spray gun which utilizes trigger-directed air or pneumatic control signals to call for various combinations of atomizing air, fan air and fluid or coating material. FIGS. 4*a* and 4*b* show two resulting fan patterns.

A method and system of the present invention utilizes the atomizer which is preferably made of machinable plastic which makes the atomizer ergonomic and user friendly. In other words, the atomizer is lightweight.

The atomizer typically includes a gun body 12 and an integrally formed handle hook 10 for supporting the atomizer. The atomizer also includes an air cap 11 mounted on a spray head or collector 13 by a ring 23. The spray head 13 mixes paint entering the spray head 13 at a fluid inlet tube 14. Atomizing air and fan air enter separately at a fan air inlet tube 15 and an atomizing air inlet tube 16, respectively, as shown in FIGS. 1 and 2. In general, the air cap 11 is specifically designed to use a high volume of air at low pressure (HVLP) and direct the air toward the coating material. The volume of air is in the 15–35 CFM range and the static pressure at the gun head is preferably in the range of 12 to 15 lbs.

The atomizer includes a positionable trigger 17 which, when depressed, moves a needle 22 and an air valve shaft or plunger mechanism 60, as shown in FIG. 5, against a spring 18. A plunger nut 72 slidably supports the plunger mechanism 60 and is threadedly secured in a handle portion of the gun body 12. The plunger mechanism 60 includes a plunger piston 73 (i.e. FIG. 5*b*) which is sealingly, slidably mounted within an aperture or cavity 28 formed or inserted in the handle portion of the gun body 12.

As shown in FIG. 1, compressed high pressure air enters the atomizer handle of the gun body 12 at an inlet fitting 19. Low and high air control signals exit the atomizer handle of the gun body 12 at outlet or exit fittings 20 and 21, respectively.

Referring now to FIG. 5, in combination with FIGS. 5*a* through *c*, at a rest position of the trigger 17 (i.e, FIG. 5*a*), compressed air enters the handle of the atomizing device through a passage or cavity 27. The compressed air enters the trigger or plunger valve cavity 27 but is held trapped between O-rings 29 and 30. In the rest position, fluid enters fluid passages 31 and 32 in the tube 14 and the spray head 13, respectively.

Fluid is held in the passage 32 by a needle return spring 33, the needle 22, a fluid tip 26, and fluid packing 24. As shown in FIG. 5, the gun needle 22 extends through the trigger 17. At the rear of the gun, a needle stop 7, a spring stop 8 and an adjustment spring 9 are located in a conventional fashion. The packing 24 fluidly seals and supports the gun needle 22. The gun needle 22 also extends through the gun trigger 17 which is pivotally mounted on the gun body 12 at a gun trigger axle 61 as indicated in FIG. 1.

As the trigger 17 is depressed, it engages and moves the shaft 60 and depresses the spring 18, and moves the O-rings 29 and 30 backward to the position of FIG. 5*b*. Compressed air flow is stopped by O-ring 34 through passageways 35 in the piston 73. The compressed air is then released back out of the handle of the body 12 through a control passageway 36, thereby becoming an air control "signal" to a series of valves or control means shown in FIG. 6.

Figure 6:
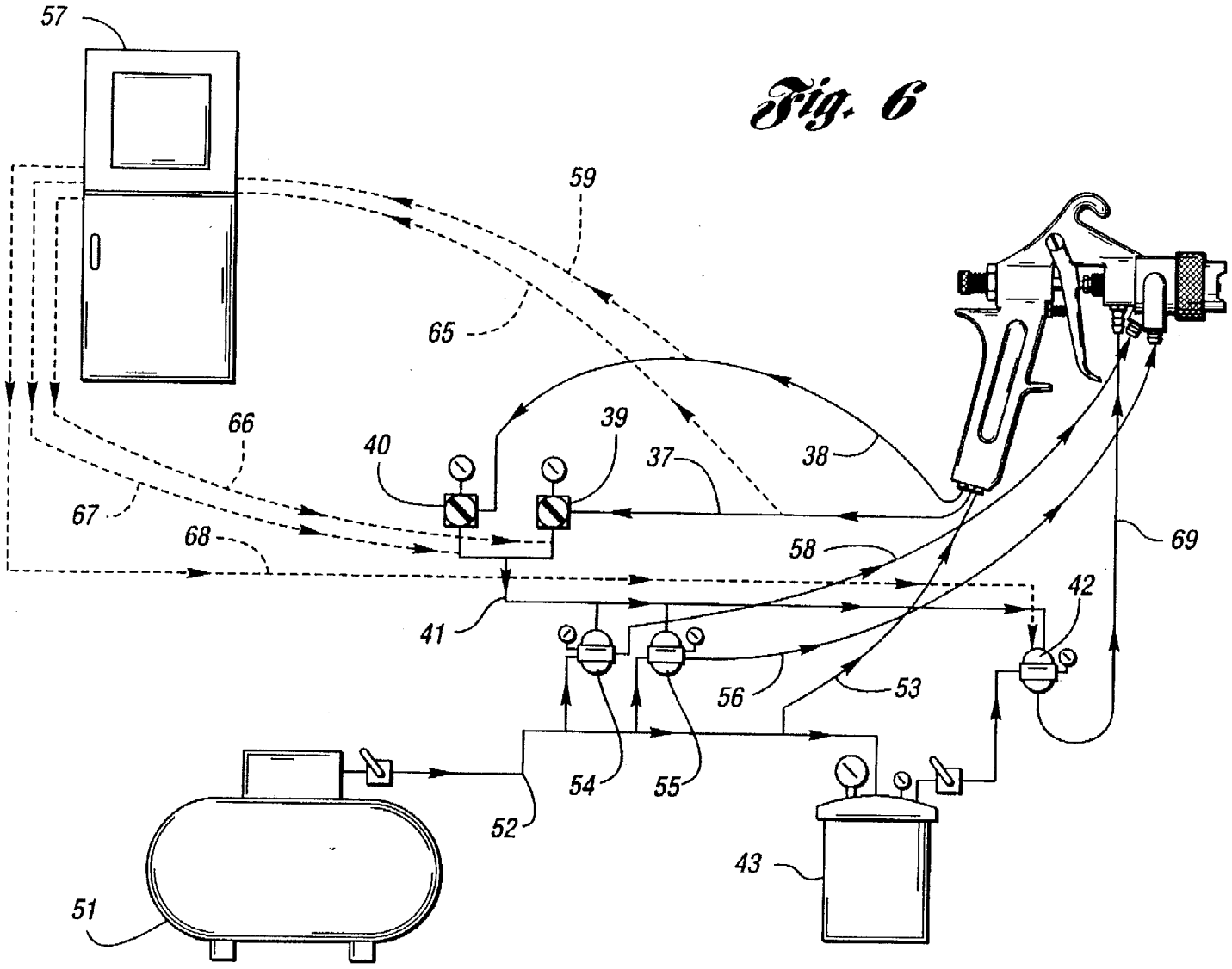
FIG. 6 is a schematic view of the system of the present invention illustrating various valves and their relationship to the other components of the system.

Referring now to FIG. 6 in combination with FIG. 5*b*, the air impulse or control signal released from the atomizer body 12 travels to an on/off air hose 37 fluidly coupled to the fitting 20. Air regulators 39 and 40 control the amount of compressed air to an on/off hose 41 fluidly coupled thereto. The air regulator 39 is preset to a desired "low" position, and, in turn, sends a low signal through the hose 41. For example, if the object to be sprayed has narrow edges (½" to 2" wide), the regulator 39 (and booster valves 54 and 55 to be described in detail hereinbelow) may be set as follows:

Regulator 39—5–15 lbs/sq inch at 5 SCFM
Booster Valve 54—3–15 lbs/sq inch at 10 SCFM
Booster Valve 55—3–15 lbs/sq inch at 10 SCFM When the on/off hose 37 communicates the air impulse from the atomizer body 12, air travels from the regulator 39 to an air piloted fluid regulator 42 by means of an air regulator hose 41. As a result, the fluid regulator 42 releases fluid (5–15 lbs. low) to the spray atomizer via fluid line 69. At the same time, fan air and atomizing air from the boosters 54 and 55 travel to the atomizer by means of air hoses 58 and 56, respectively.

A compressor 51 or source of high pressure air communicates with the valves 54 and 55 via a hose or pipe 52. The compressor 51 also communicates with a pressure pot or pump 43 and the gun body 12 via an air hose 53. In turn, the pressure pot communicates with the fluid regulator 42.

The spray atomizer is "charged" with "low" atomizing air, "low" fan air and "low" fluid at a desired "low" position. Fan air is now flowing through an inlet port 45 into a fan air cavity 46 and out a fan air exit port 47 of the cap 11. Atomizing air flows through an inlet port 48, into an atomizing air cavity 49, a distributor 71 and out an exit port 50. The exit port 50 and the two opposite spaced fanning exit ports 47 extend through the air cap 11. The size of the central exit port 50 as well as the size and spacing of fanning ports 47 determine particle size and fan shape. Generally, higher CFM and pressures in the fan hoses combined with lower CFM and pressure in the atomizing port 50 results in longer flat fan patterns as shown in FIG. 4*a*. Higher fluid deliveries also contributes to larger fans. Conversely, low fan air and fluid delivery results in smaller rounder fans, as shown in FIG. 4*b*.

As an operator continues to depress the trigger 17, the trigger 17 engages the needle 22 at a stop 25 on the needle 22 as shown in FIG. 1. The needle 22 now shifts backward, depressing the needle return spring 33, allowing fluid to escape to the fluid tip 26 from a fluid tube 64, opening exit port 44. The tube 64 is threaded to the gun body 12 by a collector nut 63 (i.e. FIG. 1) and a packing nut 62 slidably supports the needle 22 within the tube 64.

Referring now to FIG. 3, fluid is atomized by air from the exit port 50 and flattened into a fan shape by air from the exit ports 47. Referring to FIG. 4*b*, the resulting fan configuration is small as shown therein.

Assuming the operator desires to spray a wide area of the part, the operator pulls the trigger 17 backward to, in turn, further push the plunger mechanism 60, which depresses the plunger spring 18 fully, to the position of FIG. 5*c*. The O-rings 29 and 30 block the control passage 36 and compressed air now escapes through a control passage 70 (i.e. FIG. 5*c*). This "impulse" or signal is communicated through an on/off air hose 38 to air regulator 40 to, in turn, signal the release of a "higher pressure". This high signal is sent through the air hose 41 into the booster valves 54 and 55. An example might be:

Regulator 40—15–50 lbs at 5 SCFM
Booster Valve 54—10–50 lbs at 15 SCFM
Booster Valve 55—15–30 lbs at 15 SCFM Referring again to FIG. 6, when the on/off hose 38 communicates the air impulse from the atomizer base 12 and air line 38, compressed air travels from the regulator 40 to the air piloted fluid regulator 42 by means of the air hose 41. The fluid regulator 42 releases fluid (15–50 lbs. high), linked by the fluid hose 69 to the spray atomizer. At the same time, fan air and atomizing air from the boosters 54 and 55 now travels to the atomizer by means of air hose 58 and 56, respectively. The spray atomizer is now "charged" with "high" atomizing air, "high" fan air and "high" fluid at a desired "high" position.

Referring to FIG. 5, fan air is now flowing through inlet port 45 into cavity 46 and out exit port 47. Atomizing air is now flowing through inlet port 48, into cavity 49, into distributor 71 and out exit port 50. As the operator continues to depress the trigger 17, the trigger 17 now engages the needle 22 at the stop 25 on the needle 22. The needle 22 now shifts backward, depressing the needle return spring 33, allowing fluid to escape through the fluid tip 26 and out port 44.

Referring again to FIG. 3, fluid is atomized by air from the exit port 50 and flattened into a fan shape by fan air from the ports 47.

Referring to FIG. 4*a*, the fan configuration would be large as shown therein.

An alternative embodiment of the method and system of the invention is shown in FIG. 6 wherein a programmable device such as a programmable controller (i.e., P.C. or P.L.C.) 57 may be used. Solenoids within the P.C. would convert the previously described air impulses along lines 59 and 65 into electric signals. The P.C. 57 would be preprogrammed according to the configuration of the part to be sprayed. Transducers (not shown) also within the P.C. 57 would interpret the preprogrammed values from the electrical signals and exert various air pressures to the two air booster valves 54 and 55 along lines 66 and 67. The air booster valves 54 and 55 (one for fan and one for atomizing air) would then supply the atomizer with desired levels of fan air and atomizing air, respectively.

In a similar manner, another P.C.-operated transducer (not shown) would send the desired air pressure to the air piloted fluid regulator 42 via line 68. The preprogrammed fluid pressure from the regulator 42 would then be delivered to the atomizing device.

The trigger valve or plunger mechanism 60 as shown in FIG. 5 could be replaced with electric switches in the handle of the body 12. The operator could then send an electrical signal to the solenoids which, in turn, open the preprogrammed valves as shown in FIG. 6. Response would be quicker as well. However, due to safety and ergonomic factors, the plunger mechanism 60 shown in FIG. 5 is still the preferred embodiment.

While the best mode for carrying out the invention has been described in detail, those familiar with the art to which this invention relates will recognize various alternative designs and embodiments for practicing the invention as defined by the following claims.

What is claimed is:

1. A method for air spray coating an article with a coating material, the method comrising the steps of:

manually generating a first control signal;

supplying atomizing air to an atomizing device having a spray head at a first predetermined flow rate in response to the first control signal;

supplying the coating material to the atomizing device at a second predetermined flow rate in response to the first control signal;

supplying fan air to the atomizing device at a third predetermined flow rate in response to the first control signal;

manually generating a second control signal;

supplying the atomizing air to the atomizing device at a fourth predetermined flow rate in response to the second control signal;

supplying the coating material to the atomizing device at a fifth predetermined flow rate in response to the second control signal; and supplying the fan air to the atomizing device at a sixth predetermined flow rate in response to the second control signal, wherein the atomizing air, the fan air and the coating material are independently controlled.

2. The method of claim 1 wherein each of the steps of manually generating includes the step of actuating the atomizing device to generate the first and second control signals.

3. The method of claim 2 wherein the atomizing device includes a positionable trigger coupled to a valve and wherein each of the steps of actuating includes the step of adjusting the position of the trigger wherein the valve generates the first and second control signals in response to the position of the trigger.

4. The method of claim 3 wherein the valve is a pneumatic valve and wherein the first and second control signals are pneumatic control signals.

5. The method of claim 1 wherein each of the predetermined flow rates is programmable.

6. The method of claim 1 wherein the first predetermined flow rate is different than the fourth predetermined flow rate.

7. The method as claimed in claim 1 wherein the second predetermined flow rate is different than the fifth predetermined flow rate.

8. The method as claimed in claim 1 wherein the third predetermined flow rate is different than the sixth predetermined flow rate.

9. The method as claimed in claim 6 wherein the second predetermined flow rate is different than the fifth predetermined flow rate.

10. The method as claimed in claim 7 wherein the third predetermined flow rate is different than the sixth predetermined flow rate.

11. A system for air spray coating an article with a coating material, the system comprising:

means for manually generating first and second control signals;

an atomizing device having an input coating passage, a separate atomizing air passage, a separate fan air passage and a spray head;

a source of coating material fluidly coupled to the input coating passage of the atomizing device for supplying the coating material to the atomizing device;

a source of pressurized air coupled to the atomizing air and fan air passages of the atomizing device for supplying atomizing air and fan air, respectively, to the atomizing device; and control means for fluidly coupling the source of coating material to the input coating passage and for coupling the source of pressurized air to the atomizing air and fan air passages, the control means being responsive to the first control signal to (1) cause the atomizing air to flow from the source of pressurized air to the atomizing air passage at a first predetermined flow rate; (2) cause the coating material to flow from the source of coating material to the input coating passage at a second predetermined flow rate; and (3) cause the fan air to flow from the source of pressurized air to the fan air passage at a third predetermined flow rate; and wherein the control means is also responsive to the second control signal to (4) cause the atomizing air to flow from the source of pressurized air to the atomizing air passage at a fourth predetermined flow rate; (5) cause the coating material to flow from the source of coating material to the input coating passage at a fifth predetermined flow rate; and (6) cause the fan air to flow from the source of pressurized air to the fan air passage at a sixth predetermined flow rate, wherein the atomizing air, the fan air and the coating material are independently controlled.

12. The system as claimed in claim 11 wherein the means for manually generating the first and second control signals is coupled to the atomizing device.

13. The system as claimed in claim 12 wherein the atomizing device includes a positionable trigger and wherein the means for manually generating the first and second control signals includes a valve coupled to the trigger so that adjusting the position of the trigger generates the first and second control signals.

14. The system as claimed in claim 13 wherein the valve in a pneumatic valve and wherein the first and second control signals are pneumatic control signals.

15. The system as claimed in claim 11 wherein each of the predetermined flow rates is programmable.

16. The system as claimed in claim 14 wherein the atomizing device includes a body and wherein the pneumatic valve is mounted on the body of the atomizing device.

17. An atomizing device for air spray coating an article with a coating material, the atomizing device comprising:

a body;

a spray head mounted on the body;

an atomizing air passage for receiving atomizing air;

a separate fan air passage for receiving fan air;

an input coating passage for receiving coating material; and means mounted on the body for manually generating first and second control signals adapted to be communicated to control means located a distance away from the atomizing device and which is responsive to the control signals, for independently controlling predetermined flow rates of the atomizing air, the fan air and the coating material.

18. The atomizing device of claim 17 further comprising a positionable trigger mounted on the body and wherein the means for manually generating includes a valve coupled to the trigger for manually generating the first and second control signals in response to the position of the trigger.

19. The atomizing device of claim 18 wherein the valve is a pneumatic valve and wherein the first and second control signals are pneumatic control signals.

20. The atomizing device of claim 19 further comprising an input pneumatic control passage adapted to be coupled to a source of pressurized air and a pair of output pneumatic control passages, wherein each of the input and output pneumatic control passages are formed in the body and wherein the valve selectively fluidly communicates the input pneumatic control passage with one of the output pneumatic control passages in response to the position of the trigger to manually generate its corresponding pneumatic control signal.

* * * * *